United States Patent [19]

Flemings et al.

[11] 4,011,901

[45] Mar. 15, 1977

[54] METHOD DETERMINING THE SUITABILITY OF METAL COMPOSITIONS FOR CASTING

[75] Inventors: Merton C. Flemings, Cambridge; Kenneth P. Young, Arlington, both of Mass.

[73] Assignee: Massachusetts Institute of Technology, Cambridge, Mass.

[22] Filed: Mar. 10, 1976

[21] Appl. No.: 665,604

[52] U.S. Cl. ..... 164/4; 73/59

[51] Int. Cl.[2] ..... B22D 1/02

[58] Field of Search ..... 164/4, 154; 73/59, 61 LM, 73/432 R, DIG. 9

[56] References Cited

UNITED STATES PATENTS

| | | | |
|---|---|---|---|
| 3,693,412 | 9/1972 | Kalousek | 73/59 |
| 3,803,903 | 4/1974 | Lin | 73/59 |
| 3,948,650 | 4/1976 | Flemings et al. | 75/135 |
| 3,951,651 | 4/1976 | Mehrabian et al. | 75/135 |

*Primary Examiner*—John E. Roethel

*Attorney, Agent, or Firm*—Arthur A. Smith, Jr.; Paul J. Cook; Robert Shaw

[57] ABSTRACT

A process is provided by determining the castability of a metallic composition comprising a metal matrix containing secondary solid and discrete degenerate dendrites. The composition is heated and a calibrated probe is contacted under force to the surface of the composition and a parameter of distance the probe travels into the composition as a function of the force is determined. The composition is castable when the parameter measured corresponds to the condition when at least about 50 wt. % of the secondary solid is liquified and between about 25 and 90 wt. % of the total composition is liquified.

16 Claims, 2 Drawing Figures

METHOD DETERMINING THE SUITABILITY OF METAL COMPOSITIONS FOR CASTING

BACKGROUND OF THE INVENTION

The invention herein described was made in the course of work performed under a contract with the Department of the Army.

This invention relates to a method and apparatus for determining the suitability of liquid-solid metal compositions for casting.

Prior to the present invention, solid metal compositions have been prepared comprising discrete degenerate dendrite metal particles homogeneously distributed throughout a secondary metal solid. These compositions and methods for their preparation are described in copending U.S. patent application Ser. Nos. 379,991 and 379,990, filed July 17, 1973, each assigned to the assignee of this application. U.S. application serial Ser. No. 379,991 is a continuation in part of Ser. No. 258,383, filed May 31, 1972 and Ser. No. 153,819, filed June 16, 1971. U.S. application Ser. No. 379,990 is a continuation in part of Ser. No. 278,457, filed Aug. 7, 1972. All of these applications are incorporated herein by reference. As described in these applications, solid metal compositions are prepared comprising "primary solids" and "secondary solids" optionally containing third phase particles. These compositions can be reheated to form liquid-solid compositions which can be cast.

These compositions are prepared by heating a metal or metal alloy, which when frozen from a liquid state forms a dendritic network, to a temperature at which most or all of the metal composition is in a liquid state and vigorously agitating the composition to convert any solid particles therein to degenerate dendrites or nodules having a generally spheroidal shape. The agitation can be initiated either while the metallic composition is all liquid or when a small portion of the metal is solid, but containing less solid than that which promotes the formation of a solid dendritic network. Agitation can be continued with cooling and continued or can be initiated after cooling is initiated. If third phase particles are to be added to the metallic composition, they are added after all or a portion of the primary solids have been formed and they are dispersed within the metallic compositions such as by agitation. The resultant composition then can be cooled to form a slug which can be formed or cast subsequently by heating and shaping.

By the term "primary solid" as used herein is meant the phase or phases solidified to form discrete degenerate dendrite particles as the temperature of the melt is reduced below the liquidus temperature of the alloy into the liquid-solid range prior to casting the liquid-solid slurry formed. By the term "secondary solid" as used herein is meant the phase or phases which solidify from the liquid in the slurry at a lower temperature than that at which the primary solid particles are formed after agitation ceases. The primary solids obtained differ from normal dendrite structures in that they comprise discrete particles suspended in the remaining liquid matrix. Normally solidified alloys, in the absence of agitation have branched dendrites separated from each other in the early stages of solidification, i.e., up to 15 to 20 weight percent solid, and develop into an interconnected network as the temperature is reduced and the weight fraction solid increases. The structure of the compositions cast in accordance with this invention prevents formation of the interconnected network by maintaining the discrete primary solids separated from each other by the liquid matrix even up to solid fractions of 60 to 65 weight percent. The primary solids are degenerate dendrites in that they are characterized by having smoother surfaces and less branched structure which approaches a spherical configuration than normal dendrites and may have a quasi-dendritic structure on their surfaces but not to such an extent that interconnection of the particles is effected to form a network dendritic structure. The primary particles may or may not contain liquid entrapped within the particles during particle solidification depending upon the severity of agitation and the period of time that particles are retained in the liquid-solid temperature range. However, the weight fraction of entrapped liquid is less than that existing in a normally solidified alloy at the same temperature without agitation.

The secondary solid which is formed during solidification from the liquid matrix subsequent to forming the primary solid contains one or more phases of the type which would be obtained during solidification of a liquid alloy without vigorous agitation. That is, the secondary solid can comprise dendrites, single or multiphase compounds, solid solutions, or mixtures of dendrites, compounds and/or solid solutions.

As set forth above, the composition cast in accordance with this invention optionally can contain third phase solid particles homogeneously distributed within the primary solid-secondary solid matrix. The third phase particles are incorporated in the primary solid-secondary liquid slurry by adding them to the slurry and agitating the resultant composition until the third phase particles are dispersed homogeneously. The third phase particles have a surface composition that is either wet or not wet by the liquid portion of the slurry to which it is added. As employed herein, third phase particles that are wet refer to compositions which, when added to a metal or metal alloy at or slightly above the liquidus temperature of the metal or metal alloy and mixed therein, as by agitation with rotating blades, for a suitable period to effect intimate contact therewith, e.g., about 30 minutes, are retained in measurable concentrations within the liquid after agitation thereof has ceased and the resultant composition is allowed to return to a quiescent state when the metal or metal alloy is at or slightly above the liquidus temperature. When third phase particles are incorporated into a metal or metal alloy which wets the particles at the liquidus temperature of the metal or metal alloy, the particles are retained therein in concentrations from a measurable concentration of slightly above the 0% by weight, and generally up to about 5% by weight. Third phase particles having a surface composition that is not wet by the liquid metal is not retained homogeneously in measurable concentrations within the liquid after the agitation thereof has ceased and the resultant composition is allowed to return to a quiescent state.

In forming the primary solid-secondary solid compositions, the agitation employed is sufficient to prevent formation of interconnected dendritic networks or to substantially reduce of eliminate dendritic networks already formed on the solid particles.

One commercially important method for shaping metallic compositions containing primary solids comprises forming discrete slugs or blanks of the composition having a volume approximately that of the desired final cast article. The slug is cooled to a solid and stored until it is to be reheated and cast. In reheating the slug, it is necessary that the fraction solid present in the slug during casting be closely controlled. When the fraction solid is too high, the composition will fail to fill the mold cavity. When the fraction solid becomes too low, the desired properties of the composition containing primary solids will be substantially changed. That is, metallic compositions containing primary solids are thixotropic so that during periods of no agitation (when strain rate is zero) they exhibit a high shear stress, while during agitation, they exhibit shear thinning (shear stress decreases rapidly with increased strain rate) and therefore the composition can be cast when containing high fraction solids of up to about 60 to 65 weight percent solids. When cast in this state, the mold is subjected to far less heat as compared to that when the composition is cast when liquid so that the life of the mold is greatly increased when casting the compositions containing primary solids. Thus, in this respect, it is desirable to cast these compositions containing as high fraction solids as possible. Furthermore, compositions containing the higher fraction solids entrap little or no gas when being cast which is not the case with liquid compositions or compositions containing fraction solids. In addition, with compositions containing third phase particles, the increased liquid fraction and decreased fraction primary solids resulting from excessive reheating may cause the solid third phase particles to become segregated within the composition resulting in a cast article having nonhomogeneous physical characteristics.

Attempts to monitor the desired degree of reheating solely by monitoring the temperature of the reheated slug have not been satisfactory. With alloys, particularly those which melt over a narrow range, it is difficult to obtain reproducible results to obtain slugs having a fraction solid within the desired high range. Furthermore, even if a procedure for relating measured slug temperature to fraction solid in the slug were available, its cost and the time necessary to obtain desired accuracy would be incompatible with normal operating procedures existing in present production procedures. In addition, with higher temperature materials such as steel, thermocouples deteriorate rapidly and are expensive.

SUMMARY OF THE INVENTION

In accordance with this invention the castability of metallic composition containing discrete degenerate dendrites is provided. The metallic composition is heated and a calibrated probe under force is contacted to its surface. A parameter of distance the probe travels within the composition as a function of the force is determined. The composition is considered castable when at least about 50 wt. % of the secondary solid in the composition becomes liquid and between about 25 and 90 wt. % of the total composition becomes liquid. The composition then is cast.

DESCRIPTION OF SPECIFIC EMBODIMENTS

Figure 1:
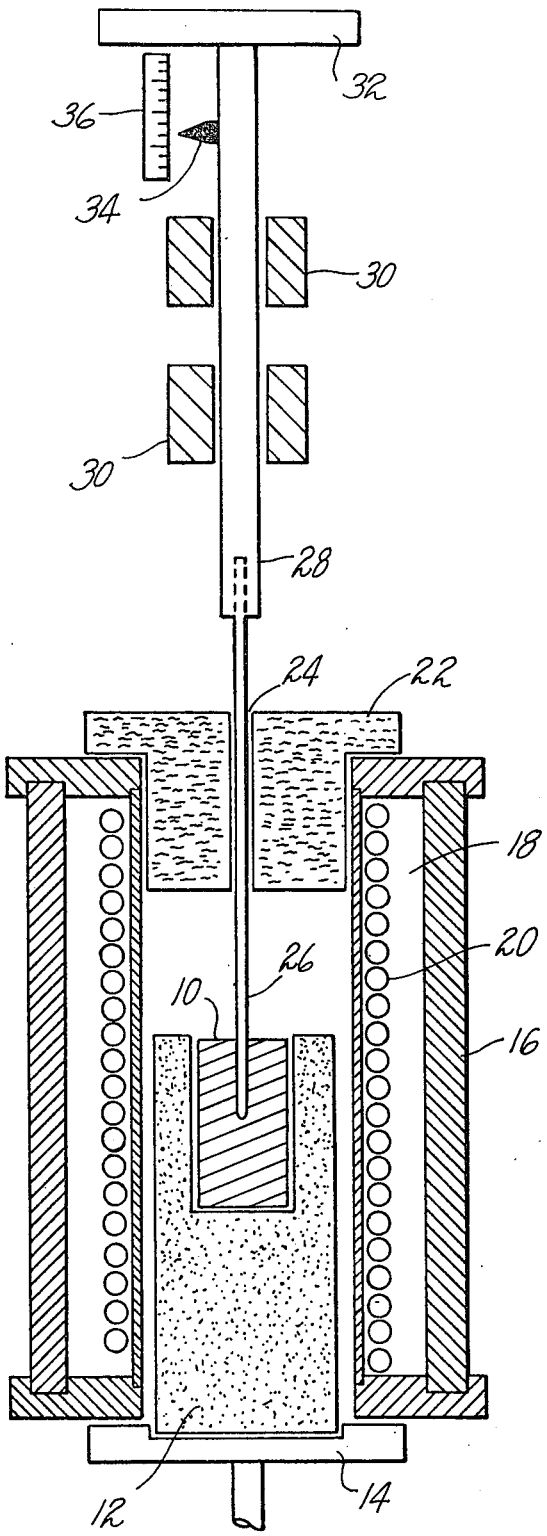
FIG. 1 is a cross-sectional view of an apparatus useful in the process of this invention.

Referring to FIG. 1, a metal slug 10 comprising primary solid of discrete degenerate dendrites and secondary solid is positioned in a crucible 12 formed of a heat resistant material such as bonded silica or clay graphite. The crucible 12 is supported on a pedestal 14 which is adapted to be raised or lowered within furnace 16 by any suitable means (not shown). The furnace 16 is provided with a chamber 18 adapted to house induction coil 20 which surrounds the slug 10. The top of the furnace 16 is sealed with a thermal insulation 22 such as firebrick provided with an opening 24 through which an inert atmosphere can be added and through which probe 26 is extended. Probe 26 is secured to steel shaft 28 which, in turn, is extended within linear roller bearings 30. A platform 32 adapted to support a weight is secured to shaft 30 as is indicator 34. Distance scale 36 is positioned adjacent the indicator 34 to permit the operator to determine the length of penetration of the probe 26 into slug 10 when slug 10 is heated.

Figure 2:
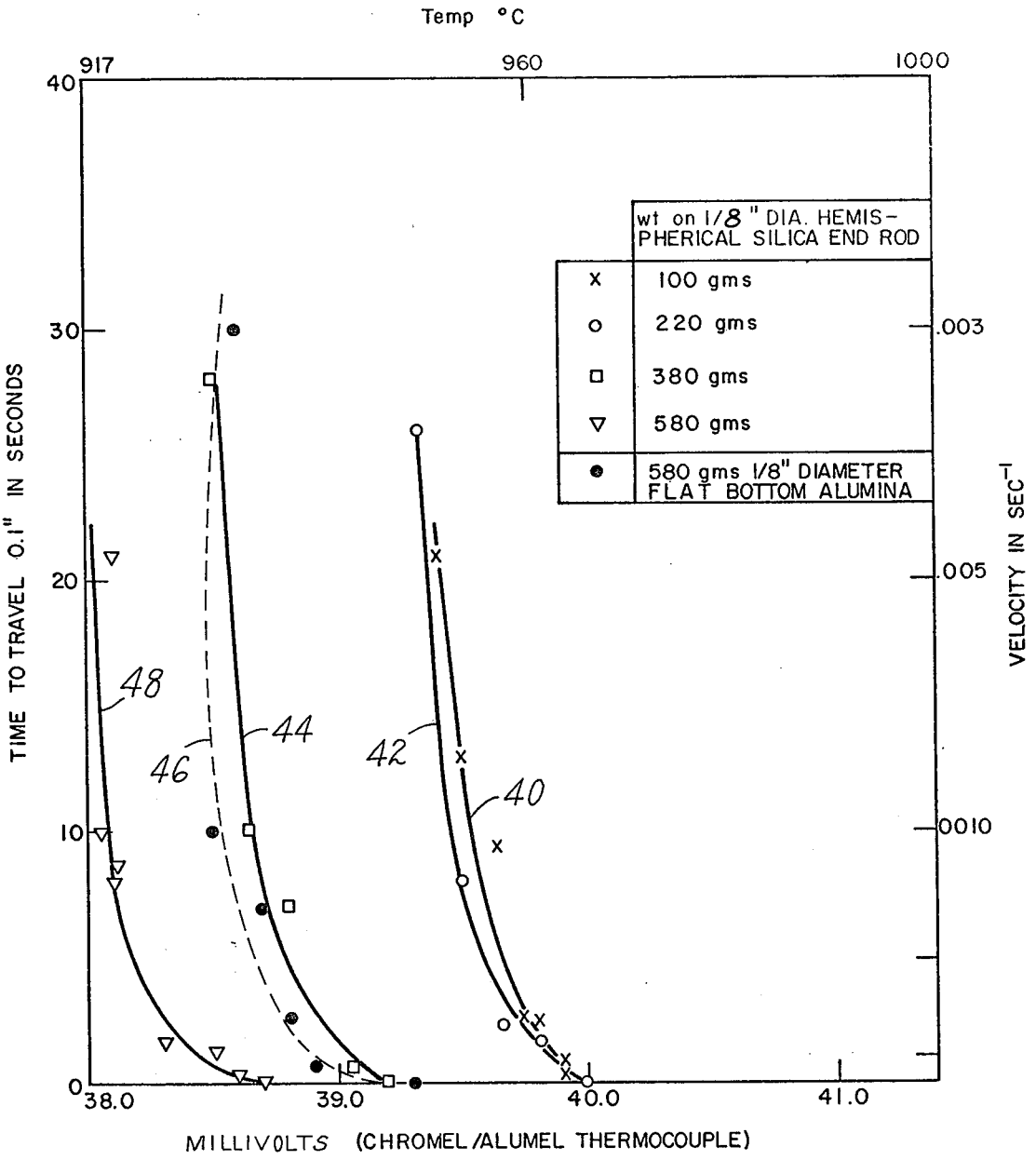
FIG. 2 is a graph showing the relationship between slug temperature and probe distance or velocity.

The data generated to obtain the graph shown in FIG. 2 was obtained under the following conditions. A slug was formed from copper base alloy 905 (88 wt. % Cu, 10 wt. % Sn, 2 wt. % Zn, liquidus nominally 999° C) and comprised 50 wt. % primary solids. Each of the slugs used during the testing was cylindrically shaped and was 2.15 inches long by 1.25 inches in diameter. The slugs were placed within $CO_2$-bonded silica or clay graphite crucibles 12 and raised into and lowered from the furnace 16 by means of a foot pedal (not shown). The firebrick cap 22 had a ¼ inch diameter hole 24 through which extended a 1/16 inch diameter silica tube 26, closed at its base as a hemispherical cap. The steel tube 28 slides within two roller bearings 30 approximately 3 inches apart to maintain rigidity.

After insertion of the crucible and slug into the furnace the preweighted silica rod 26 was lowered centrally to the top surface of the slug and then withdrawn and held ¼ inch above the slug surface. Different weights were placed on the pan 32 for each slug as shown in the table in FIG. 2. Additionally, a chrome/alumel control thermocouple sheated in ⅛ inch outside diameter stainless steel was inserted into a 1 inch deep 5/31 inch diameter hole drilled vertically 3/16 inch in from the slug wall. Power was turned on to the induction coil 20, fed by a 50 KW, 3.8 KC unit and heating was monitored via the thermocouple until a temperature within the solid/liquid region was achieved and maintained. The preweighted and preheated silica rod 26 was greatly lowered to the slug surface. The time taken for the rod to travel a distance of between 0.1 – 0.5 inches was then measured by observing the movement of fixed pointer 34 past scale 36. This procedure then was repeated for the same slug at different temperatures.

FIG. 2 shows a series of graphs developed for the different slugs, each subjected to a different force as shown in the table in the figure. In addition, a run was made with a rod made from alumina and having a flat bottom in contact with the slug. The graphs show time for the rod to travel 0.1 inch or velocity of the rod into the slug as a function of temperature as by measured by EMF generated by a chormel/alumel thermocouple. As shown in FIG. 2, the curves developed exhibit consistent shape. The one curve obtained with the flat bottom rod was shifted to a higher temperature (lower fraction solid) as compared to the curve obtained with the same weight but with a rod having a hemispherical cap. Slugs cast from the temperature ranges of curves 40 and 42, when partially liquified, were found to produce relatively poor castings due primarily to air entrapment in the casting. On the other hand, slugs cast from the temperature ranges of curves 44, 46 and 48 were found to produce higher quality castings with the castings obtained between the values of 920° C and 950° C being preferred. These results show that with this particular alloy, a force greater than 220 grams with the particular rod configuration should be used in order to obtain data which can be accurately related to castability. In addition, the rod configuration and weights at 380 grams up to 580 grams were found to produce data that is directly applicable to determining casting quality. Thus, when one desires to determine castability of a slug of a particular alloy, the particular apparatus employed should be calibrated by determined casting quality for a given set of readings for the distance parameter of the rod prior to utilizing the process of this invention in a commercial context.

It is apparent from the above that equivalent results can be obtained by measuring the velocity of the rod, the distance travelled by the rod or the time the rod requires to travel a given distance. In addition, equivalent results can be obtained by measuring the resistance to deformation of the slug when the rod moves into the slug at a constant velocity.

The composition employed in this invention can be formed from any metal alloy system or pure metal regardless of its chemical composition which, when frozen from the liquid state without agitation forms a dendritic structure. Even though pure metals and eutectics melt at a single temperature, they can be employed herein. Representative suitable alloys include lead alloys, magnesium alloys, zinc alloys, aluminum alloys, copper alloys, iron alloys, nickel alloys, cobalt alloys. Examples of these alloys are lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, super-alloys, and cobalt-chromium alloys, or pure metals such as iron, copper or aluminum.

The third phase particles, optionally included in the metal composition include particles which are not wet such as graphite, metal carbides, sand, glass, ceramics, metal oxides such as thorium oxide, pure metals and alloys, etc. or particles which are wet such as tungsten carbide in aluminum, magnesium or zinc or nickel coated graphite in aluminum alloys.

We claim:

1. A process for determining the castability of a metallic composition comprising a metal matrix containing secondary solid and up to about 65 weight percent of discrete degenerate dendrites based upon the weight of said matrix which comprises:

a. heating said metallic composition, b. contacting a probe under force to a surface of said composition, c. determining a parameter of distance the probe travels within said composition as a function of said force, d. said probe and force being calibrated with samples of the metallic composition to determine the range of values for said parameter which corresponds to acceptable castability of said metallic composition prior to determining the castability of said metallic composition.

2. The process of claim 1 wherein said composition contains third phase solid particles.

3. The process of claim 1 wherein the velocity of the probe is measured as a function of said force.

4. The process of claim 3 wherein said composition contains third phase solid particles.

5. The process of claim 1 wherein the distance of travel of said probe within said composition is measured as a function of said force.

6. The process of claim 5 wherein said composition contains third phase solid particles.

7. The process of claim 1 wherein the prove is driven into said composition at a constant velocity and the resistance to said probe is measured as a function of said constant velocity.

8. The process of claim 7 wherein said composition contains third phase solid particles.

9. The process of casting a metallic composition comprising a metal matrix containing secondary solid and up to about 65 weight percent of discrete degenerate dendrites based upon the weight of said matrix which comprises:

a. heating said metallic composition, b. contacting a probe under force to a surface of said composition, c. determining a parameter of distance the probe travels within said composition as a function of said force, d. casting said composition when at least about 50% of said secondary solid has become liquid and between 25 and 90% of the total composition has become liquid, e. said probe and force being calibrated with samples of the metallic composition to determine the range of values for said parameter which corresponds to acceptable castability of said metallic composition prior to determining the castability of said metallic composition.

10. The process of claim 9 wherein said composition contains third phase solid particles.

11. The process of claim 9 wherein the velocity of the probe is measured as a function of said force.

12. The process of claim 11 wherein said composition contains third phase solid particles.

13. The process of claim 9 wherein the distance of travel of said probe within said composition is measured as a function of said force.

14. The process of claim 13 wherein said composition contains third phase solid particles.

15. The process of claim 9 wherein said probe is driven into said composition at a constant velocity and the resistance to said probe is measured as a function of said constant velocity.

16. The process of claim 15 wherein said composition contains third phase solid particles.

* * * * *